US008349396B2

(12) United States Patent
DeBiccari et al.

(10) Patent No.: US 8,349,396 B2
(45) Date of Patent: Jan. 8, 2013

(54) METHOD AND SYSTEM FOR CREATING FUNCTIONALLY GRADED MATERIALS USING COLD SPRAY

(75) Inventors: Andrew DeBiccari, North Branford, CT (US); Jeffrey D. Haynes, Stuart, FL (US)

(73) Assignee: United Technologies Corporation, Hartfort, CT (US)

( * ) Notice: Subject to any disclaimer, the term of this patent is extended or adjusted under 35 U.S.C. 154(b) by 1738 days.

(21) Appl. No.: 11/106,911

(22) Filed: Apr. 14, 2005

(65) Prior Publication Data

US 2006/0233951 A1 Oct. 19, 2006

(51) Int. Cl.
*B05D 1/12* (2006.01)
*B05D 5/00* (2006.01)

(52) U.S. Cl. ..... 427/140; 427/446; 427/448; 427/455; 427/456; 427/142; 427/180; 427/197; 427/205; 427/422

(58) Field of Classification Search ..... 427/446, 427/140

See application file for complete search history.

(56) References Cited

U.S. PATENT DOCUMENTS

| | | | | |
|---|---|---|---|---|
| 4,391,860 | A * | 7/1983 | Rotolico et al. | 427/446 |
| 4,705,203 | A * | 11/1987 | McComas et al. | 228/119 |
| 5,302,414 | A | 4/1994 | Alkhimov et al. | |
| 6,365,222 | B1 * | 4/2002 | Wagner et al. | 427/140 |
| 6,502,767 | B2 | 1/2003 | Kay et al. | |
| 6,503,575 | B1 * | 1/2003 | Payne et al. | 427/447 |
| 6,706,319 | B2 * | 3/2004 | Seth et al. | 427/190 |
| 2002/0185198 | A1 | 12/2002 | Pietruska et al. | |
| 2003/0126800 | A1 | 7/2003 | Seth | |
| 2003/0219542 | A1 * | 11/2003 | Ewasyshyn et al. | 427/421 |
| 2004/0110021 | A1 | 6/2004 | Seth | |
| 2005/0084701 | A1 * | 4/2005 | Slattery | 428/546 |

* cited by examiner

*Primary Examiner* — Katherine A Bareford
(74) *Attorney, Agent, or Firm* — Bachman & LaPointe, P.C.

(57) ABSTRACT

A method and system for depositing multiple materials onto a substrate is described. The method broadly comprises the steps of providing a source of a first powder material to be deposited, providing a source of a second powder material to be deposited, and sequentially depositing the first powder material and the second powder material onto the substrate at a velocity sufficient to deposit the materials by plastically deforming the materials without metallurgically transforming the particles of powder forming the materials.

9 Claims, 2 Drawing Sheets

METHOD AND SYSTEM FOR CREATING FUNCTIONALLY GRADED MATERIALS USING COLD SPRAY

BACKGROUND OF THE INVENTION (1) Field of the Invention

The present invention relates to a method and system for depositing functionally graded materials onto a substrate using a cold spray deposition technique.

(2) Prior Art

Cold gas dynamic spraying or "cold spray" has been recently introduced as a new metallization spray technique to deposit powder metal without inclusions onto a substrate. A supersonic jet of helium and/or nitrogen is formed by a converging/diverging nozzle and is used to accelerate the powder particles toward the substrate to produce cold spray deposits or coatings. Deposits adhere to the substrate and previously deposited layers through plastic deformation and bonding. U.S. Pat. Nos. 5,302,414 and 6,502,767 illustrate cold gas dynamic spraying techniques.

Currently, bond coats are applied using low pressure plasma spray (LPPS). Operation and maintenance of LPPS systems is expensive and time consuming, limiting throughput. Also, LPPS requires a vacuum chamber. The size of a given chamber limits the size of the parts that can be processed.

Recently, it has been suggested by the applicants to use "cold spray" to apply a bond coat to engine components. A system and a method for applying such a bond coat is shown in co-pending U.S. patent application Ser. No. 11/088,380, filed Mar. 23, 2005 now abandoned, entitled Applying Bond Coat to Engine Components Using Cold Spray.

Due to engine operating temperatures, strength requirements, and the like, material changes are required along the axial length of the engine. Typically, this means that separate components, each constructed from a different material, are fabricated and then bolted or welded together. In some instances, due to incompatibility between the two materials, welding cannot even be considered and bolting is the only option.

SUMMARY OF THE INVENTION

Accordingly, it is an object of the present invention to provide a system and a method for depositing multiple materials for a wide variety of purposes onto a substrate using a cold spray technique.

The foregoing object is attained by the method and system of the present invention.

In accordance with the present invention, a method for depositing multiple materials onto a substrate is described. The method broadly comprises the steps of providing a source of a first powder material to be deposited, providing a source of a second powder material to be deposited, and sequentially depositing the first powder material and the second powder material onto the substrate at a velocity sufficient to deposit the materials by plastically deforming the materials without metallurgically transforming the particles of powder forming the materials.

Further, in accordance with the present invention, there is a described a system for depositing multiple materials onto a substrate. The system broadly comprises a source of a first powder material to be deposited, a source of a second powder material to be deposited, and means for sequentially depositing the first powder material and the second powder material onto the substrate at a velocity sufficient to deposit the materials by plastically deforming the materials without metallurgically transforming the particles of powder forming the materials.

Other details of the method and system for creating functionally graded materials using cold spray, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
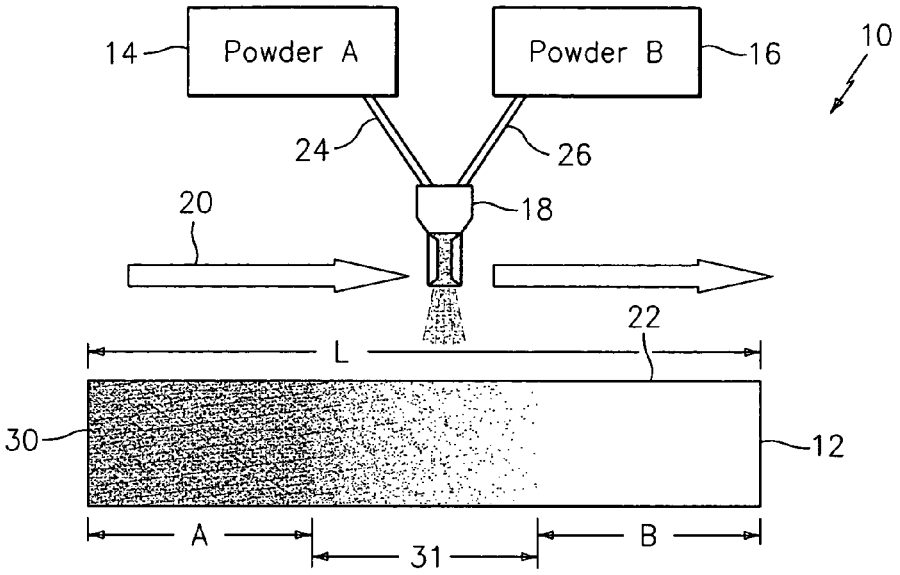
FIG. 1 illustrates a system for depositing multiple materials onto a substrate.

Referring now to the drawings, FIG. 1 illustrates a system 10 for depositing multiple materials onto a substrate or component 12. As shown therein, the system 10 includes a first source 14 of a first powdered material and a second source 16 of a second powdered material. The first and second powdered materials can be a powdered metallic material, such as a powdered alloy composition, a coating composition such as a powdered ceramic coating composition, etc. The first and second powdered materials can be two powdered materials that come from the same family, such as superalloys IN 718, an alloy sold under the trade name WASPALOY, and IN 100, or titanium alloys such as Ti 6-4, Ti 6-6-4-2 and Ti 6-2-4-6, or aluminum alloys such as 2000/4000/6000 series aluminum alloys. Alternatively, the first and second powdered materials may be dissimilar, such as dissimilar powder metal alloy compositions. For example, the system of the present invention may be used to deposit magnesium to aluminum alloys or titanium to nickel alloys. The particular materials that will be used for the first and second materials are a function of the end use for the coated substrate or component.

Each of the first and second powdered materials may have a mean particle diameter in the range of from 5 microns to 40 microns (0.2-2.0 mils). The particles may be accelerated to supersonic velocities using compressed gas, such as helium, nitrogen, other inert gases, and mixtures thereof. Helium is a preferred gas because it produces the highest velocity due to its low molecular weight.

The powdered material sources 14 and 16 may be connected to a feeder nozzle 18 by any suitable means known in the art. The feeder nozzle 18 may comprise any suitable nozzle known in the art. The feeder nozzle 18 may be stationary with respect to the substrate 12. Alternatively, the feeder nozzle 18 may move relative to the substrate 12. For example, the feeder nozzle 18 may be configured to move closer to or farther away from a surface 22 of the substrate or component 12. In addition thereto, the substrate or component 12 may have an axial length L and the feeder nozzle 18 may be configured to move in a direction 20 parallel to the axial length L and/or to the surface 22 onto which the first and second powder materials are to be deposited.

As stated before, the sources 14 and 16 may be connected to the feeder nozzle 18 using any suitable means known in the art such as feed lines 24 and 26. Means for regulating the amount of material being supplied to the feeder nozzle 18 from each of the sources 14 and 16 may be incorporated into the system 10. The regulating means may comprise any suitable regulating means known in the art.

The powdered materials may be fed to the nozzle 18 using any suitable means known in the art, such as modified thermal spray feeders. Feeder pressures are generally 15 psi above the main gas or head pressures, which pressures are usually in the range of from 200 psi to 500 psi, depending on the powder compositions. The main gas is preferably heated so that gas temperatures are in the range of from 600 to 1250 degrees Fahrenheit, preferably from 700 degrees to 1000 degrees Fahrenheit, and most preferably from 725 to 900 degrees Fahrenheit. The gas may be heated to keep it from rapidly cooling and freezing once it expands past the throat of nozzle 18. The net effect is a desirable surface temperature on the substrate or component 12 onto which the powder composition(s) are to be deposited.

The main gas that is used to deposit the particles may be passed through the nozzle 18 at a flow rate of from 0.001 SCFM to 50 SCFM, preferably in the range of from 15 SCFM to 35 SCFM. The foregoing flow rates are preferred if helium is used as the main gas. If nitrogen is used as the main gas, the nitrogen may be passed through the nozzle 18 at a flow rate of from 0.001 SCFM to 30 SCFM, preferably from 4.0 to 30 SCFM.

The pressure of the nozzle 18 may be in the range of from 200 to 500 psi, preferably from 200 to 400 psi, and most preferably from 275 to 375 psi. The powdered material may be supplied to the nozzle 18 at a rate in the range of from 10 to 100 grams/min., preferably from 15 to 50 grams/min.

The powdered material may be fed to the nozzle 18 using a non-oxidizing carrier gas. The carrier gas may be introduced at a flow rate from 0.001 SCFM to 50 SCFM, preferably from 8 to 12 SCFM, if helium is used. If nitrogen is used, the carrier gas flow rate may be in the range of from 0.001 to 30 SCFM, preferably from 4.0 to 10 SCFM.

The velocity of the powdered materials leaving the nozzle 18 may be in the range of from 825 to 1400 m/s, preferably from 850 to 1200 m/s.

The nozzle 18 may be held at a distance from the surface of the part or component to be coated. This distance is known as the spray distance and may be in the range of from 10 mm. to 50 mm.

In operation, the first powdered material may be deposited onto the surface 22 using a cold spray method wherein the powdered material particles are plastically deformed without suffering any metallurgical transformation. The second powdered material may then be deposited, again by plastic deforming the particles of the powdered material without the particles suffering any metallurgical transformation, onto the surface 22 or onto a layer of the first powdered material formed on the substrate or component 12. If desired, for a period of time, both of the first and second materials may be co-deposited to form a transition zone 31 between a layer of the first powdered material and a layer of the second powdered material.

Referring now to FIG. 1, there is illustrated a substrate or component 12 which has a layer 30 of the first powdered material deposited along a first length (Zone A) of the substrate or component 12, a transition zone 31 where a layer of co-deposited first and second powdered material is formed along a second length of the substrate or component 12 adjacent the first length, and a third length (Zone B) of the substrate or component 12 where a layer of the second powdered material is deposited. As can be seen from FIG. 1, using the system of the present invention, it is possible to form an article with multiple powder deposits which transition from one material to the other gradually over the net length of the article. This article can be used as a preform from which it is possible to fabricate an entire assembly from a single piece.

The system of FIG. 1 may also be used to apply a bond coat layer to the surface 22 of the substrate or component 12 and to then apply a top coat layer over the bond coat layer. The bond coat layer may be formed from any suitable powder composition known in the art placed in the source 14. Similarly, the top coat layer may be formed from any suitable powder composition known in the art placed in the source 16. The bond coat material may be a MCrAlY material, where M is Ni and/or Co or a variation thereof. The top coat material may be metallic or ceramic in composition. The top coat layer may be deposited first on the surface 22. If desired, for a period of time, the top coat layer material and the bond coat layer material may be co-deposited onto the top coat layer to form a transition zone. Thereafter, the top coat layer may be deposited on the interface layer. In such a case, the substrate or component 12 may be a turbine blade or vane.

Figure 2:
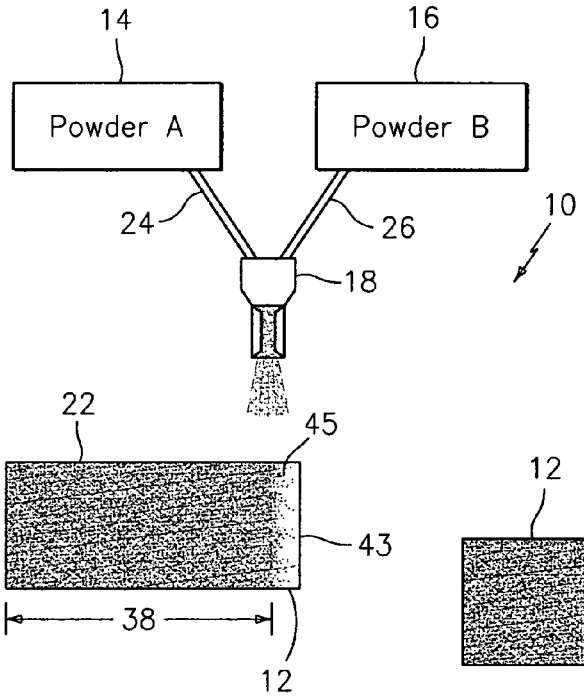
FIG. 2 illustrates a system for depositing a functionally graded material on a surface of a component to allow for welding to another component fabricated from a dissimilar material.
Figure 3:
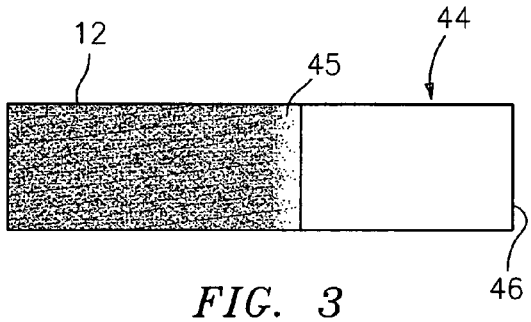
FIG. 3 illustrates a part welded to the structure formed by the system of FIG. 2.

The system of FIG. 1 may be used as shown in FIGS. 2 and 3 to deposit a functionally graded material onto a surface 22 of a component 12 for a desired length (zone 38). The functionally graded material may be used to allow for welding to another component 44 fabricated from a dissimilar material and may include a deposited transition zone 45 on the surface 22. During formation of the transition zone 45, one of the sources 14 and 16 is slowly dialed back and the other is ramped up. As a result, there is a region of co-mingled material. As shown in FIG. 3, the component 44 may be joined to the end 43 such as by welding, brazing, or any other technique known in the art which does not require a mechanical fastener. A fabricated article such as that shown in FIG. 3 is highly desirable because it avoids the need for a bolted joint.

Figure 4:
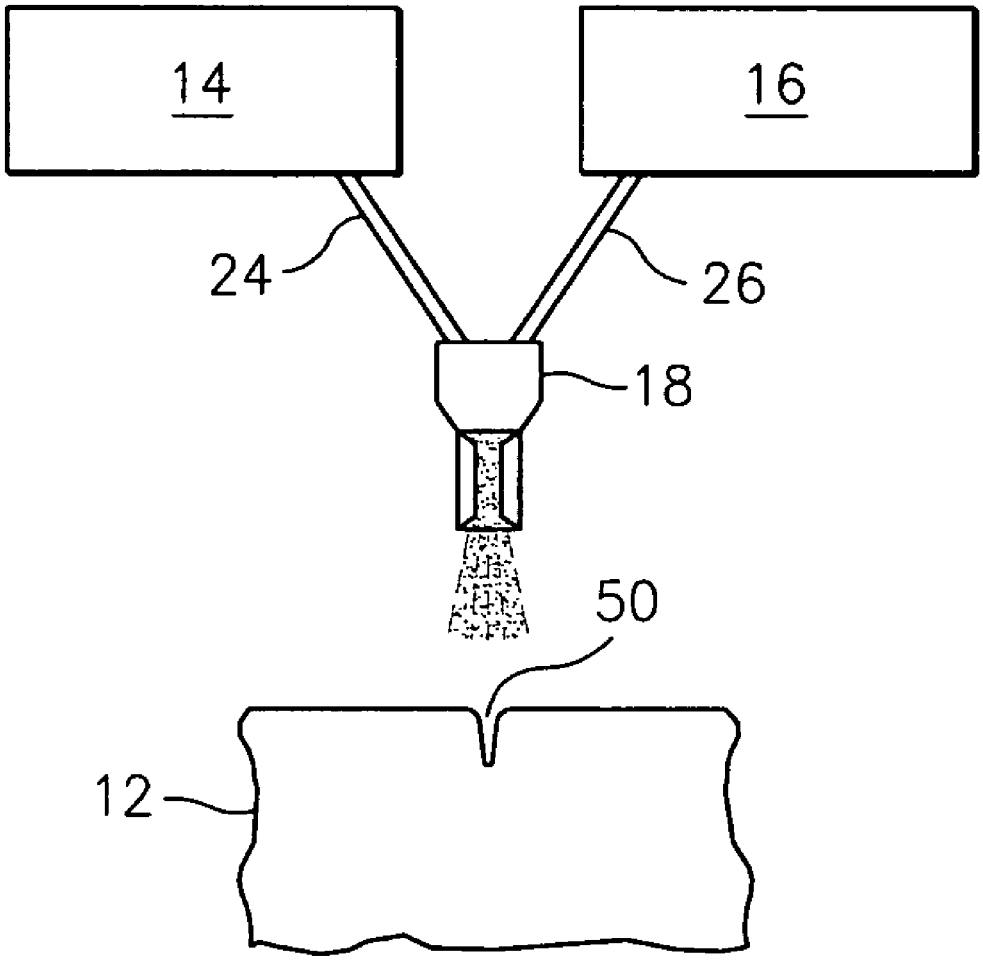
FIG. 4 illustrates a system for repairing a crack in a component.

Referring now to FIG. 4, in a repair scenario, the system of FIG. 1 could be used to adjust the boron composition of a braze powder applied to a cracked area 50 on a part 12 in need of repair. For example, a high boron content material can be applied just to the surface of the crack 50 with the remainder of the crack 50 filled in with a lower boron content material. Reducing the total boron content in this manner increases the strength of the repaired area so a superior repair is achieved.

The bonding mechanism employed by the method of the present invention is strictly solid state, meaning that the particles plastically deform but do not melt. Any oxide layer that is formed on the particles, or is present on the surface of the component or part, is broken up and fresh metal-to-metal contact is made at very high pressure.

The system and method of the present invention are advantageous because it enables one to have material that changes along an axial length of an engine component which is needed to satisfy engine operating temperatures, strength requirements, etc.

It is apparent that there has been provided in accordance with the present invention a method and system for creating functionally graded materials using cold spray which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A method for depositing multiple materials onto a substrate comprising the steps of:

providing a source of a first powder material to be deposited;

providing a source of a second powder material to be deposited;

forming a layer of multiple materials on said substrate by sequentially depositing said first powder material and said second powder material onto said substrate at a velocity sufficient to deposit said materials by plastically deforming the materials without metallurgically transforming the particles of powder forming said materials; and said sequential depositing step comprising depositing said first powder material onto a first length of a surface of said substrate, depositing said second powder material onto a second length of said surface of said substrate spaced from said first length, and co-depositing both of said first and second powder materials onto a third length of said surface of said substrate intermediate said first and second lengths so that said co-deposited powder materials are only present on said third length of said surface.

2. The method according to claim 1, further comprising providing a feeder nozzle and connecting said sources to said feeder nozzle.

3. The method of claim 1, further comprising providing a substrate having a cracked area and said sequential deposition step comprising repairing said cracked area by depositing a first powder material having a first boron content in said cracked area and thereafter depositing a second powder material having a second boron content less than the first boron content in said cracked area.

4. The method according to claim 1, wherein said source providing steps comprises providing said first source with a first powdered alloy composition and said second source with a second powdered alloy composition in the same family as said first alloy composition.

5. The method according to claim 1, wherein said source providing steps comprises providing said first source with a first powdered alloy composition and said second source with a second powdered alloy composition in a family dissimilar from that of said first alloy composition.

6. The method according to claim 1, further comprising fabricating an article from said substrate and said sequentially deposited powder materials.

7. The method according to claim 1, wherein said first powder material depositing step comprises depositing a first nickel base alloy material and said second powder material depositing step comprise depositing a second nickel base alloy material.

8. The method according to claim 1, wherein said first powder material depositing step comprises depositing a first titanium base alloy material and said second powder material depositing step comprise depositing a second titanium base alloy material.

9. The method according to claim 1, wherein said first powder material depositing step comprises depositing a first aluminum base alloy material and said second powder material depositing step comprise depositing a second aluminum base alloy material.

* * * * *